US006036148A

United States Patent [19]

Shank

[11] Patent Number: 6,036,148

[45] Date of Patent: Mar. 14, 2000

[54] FOLDING OUTDOOR CHAIR HAVING ADJUSTABLE LEGS

[76] Inventor: Dale Shank, 463 Westminster Ave., Salt Lake City, Utah 84115

[21] Appl. No.: 09/166,744

[22] Filed: Oct. 5, 1998

[51] Int. Cl.[7] ..... F16M 11/24

[52] U.S. Cl. ..... 248/188.5; 248/188.2; 297/344.18; 297/463.1

[58] Field of Search ..... 297/325, 344.18, 297/463.1; 248/188.2, 188.5

[56] References Cited

U.S. PATENT DOCUMENTS

| | | | |
|---|---|---|---|
| 595,450 | 12/1897 | Archer | 248/188.5 X |
| 2,567,989 | 9/1951 | Cheek | 248/188.5 X |
| 2,935,813 | 5/1960 | Berman et al. | 248/188.2 |
| 4,216,933 | 8/1980 | Cramer | 248/188.5 |
| 4,832,296 | 5/1989 | Schnepp | 248/188.5 X |
| 5,060,896 | 10/1991 | Hobbins | 248/188.2 |
| 5,522,642 | 6/1996 | Herzog | 297/344.18 |

*Primary Examiner*—Peter R. Brown
*Attorney, Agent, or Firm*—Terry M. Crellin

[57] ABSTRACT

An improvement in a folding chair commonly called an aluminum lawn chair comprises independently operated mechanisms on each leg of the chair that allows the length of each leg to be adjusted independently of the other legs. This allows the lawn chair to be used on so that the chair can quickly be made suitable for sitting on unlevel ground. Each leg of the folding aluminum lawn chair has a tubular member firmly attached thereto, with the lower end of each tubular member being located adjacent to or near the bottom end of the respective leg of the chair. A telescoping member is positioned inside each tubular member so that the telescoping member extends downwardly from the lower end of the tubular member, and a mechanism is provided for securing the telescoping member in any desired position in its telescopic movement extending from the tubular member. Each telescoping member of the chair can thus be adjusted to a desired position so that the chair can be made suitable for sitting on unlevel ground.

3 Claims, 1 Drawing Sheet

FOLDING OUTDOOR CHAIR HAVING ADJUSTABLE LEGS

BACKGROUND OF THE INVENTION

1. Field of the Invention

The present invention relates to folding chairs that are used outside and often called folding, aluminum, lawn chairs. In particular, the present invention relates to such folding chairs that are provided with individually adjustable legs, so that the chair can be oriented with the seat being substantially level even when the chair is used on uneven ground.

2. State of the Art

Lawn chairs are very popular, and are often used by sportsmen when camping. Most often, the ground that the lawn chairs are to be used on is substantially level, or at least level areas can be found on which to situate the chair. However, when sportsmen use the chairs at camping sites or while hunting, the ground is generally uneven or slanted. Many times, a hunter would like to use a chair in the wilds while stalking an animal. The choice of a site is usually dictated by the animal being stalked rather than by whether the site is level or not. It would be highly advantageous for the outdoorsman to have a folding chair that has individually adjustable legs that can quickly and easily be set so that the chair can be positioned on uneven ground with the seat of the chair being substantially level.

In U.S. Pat. No. 2,107,629, there is disclosed an adjustable chair that is used inside. It is not adapted to be used outside. The chair has adjustable legs that allow the chair to be elevated so that it can be utilized as a high chair for a youngster. Although the adjustable legs can be set at several heights, the adjustment mechanism is complex and certainly cannot be changed quickly or easily. The adjustment mechanism disclosed in U.S. Pat. No. 2,107,629 is designed to be set and then used for some time before being set again. The adjustment mechanism of U.S. Pat. No. 2,107,629 could not be used to quickly and easily adjust an outdoor chair to set on uneven ground. Clearly, it would be highly desirable to provide a folding lawn chair that has independent means for adjusting the length of each leg quickly and easily so that the chair can quickly be made suitable for sitting on unlevel ground.

OBJECTIVE

The principal objective of the invention is to provide an improved folding chair of the type known as aluminum lawn chairs wherein each of the legs of the chair has an independently operated means for adjusting the length of the leg quickly and easily so that the chair can quickly be made suitable for sitting on unlevel ground.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENT

Figure 1:
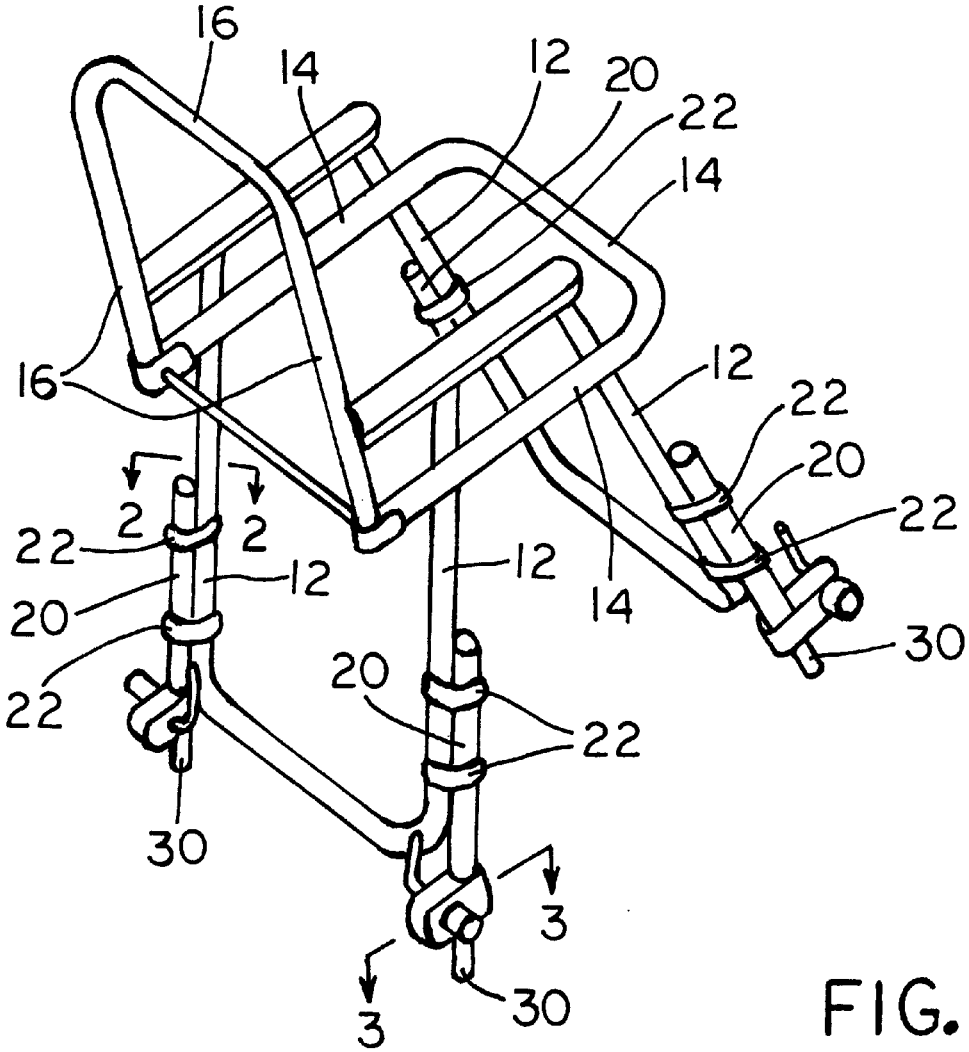
FIG. 1 is a pictorial representation of a folding lawn chair in accordance with the present invention, with the conventional webbing material forming the seat and backrest of the chair being omitted so as to show only the structural members of the chair.

In accordance with the present invention an improvement is provided in a folding outdoor chair of the type having four legs that extend downwardly from a seat portion of the chair when the chair is unfolded to its working condition in which the chair is capable of having a person sit in said chair. Such chairs are commonly called aluminum, folding lawn chairs. In FIG. 1 there is shown such a chair. The webbing material that forms the seat and backrest of the chair have been omitted from the drawing for purposes of simplicity. The chair comprises four leg members 12 that extend downwardly from the frame 14 of the seat. The backrest of the chair is formed by a frame 16 that extends upwardly from the frame 14 of the seat. The chair folds, as is well known in the art, so that the frame 16 of the backrest folds downwardly along the frame 14 of the seat, and the leg members 12 fold inwardly toward each other and alongside the frame 14 of the seat. Such a folding chair is common and extensively marketed. Accordingly, further description of the chair itself is unnecessary.

Figure 2:
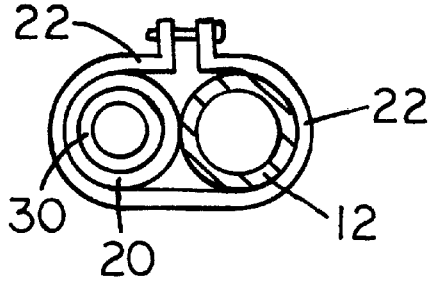
FIG. 2 is a cross section taken along line 2—2 of FIG. 1.

The present invention consists of an improvement in the common, folding lawn chair. The improvement comprises four elongate tubular members 20, with means for attaching each of the tubular members 20 to a respective leg member 12 of the chair so that a lower end of each tubular member 20 is positioned near a lower end of a respective leg member 12 of the chair. As illustrated in FIGS. 1 and 2, a pair of screw clamps 22 are provided for each tubular member 20, with the screw clamps being spaced apart along the respective tubular member 20 so as to firmly clamp or bind the respective tubular member 20 to its corresponding leg member 12.

Figure 3:
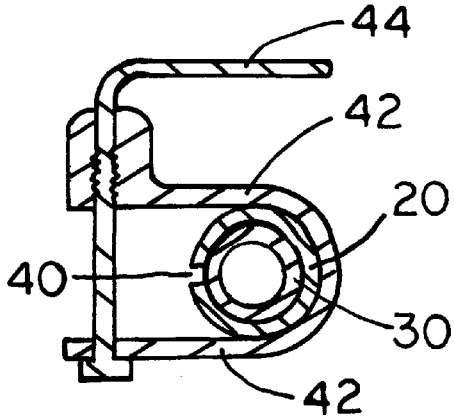
FIG. 3 is a cross section taken along line 3—3 of FIG. 1.

Referring now to FIGS. 1 and 3 of the drawings, four elongate, telescoping members 30 are provided, with each telescoping member 30 being received within a respective tubular member 20 so that a distal end of the telescoping member extends from a lower end of the respective tubular member 20 and the telescoping member 30 can slide into and out of the tubular member 20 in telescopic fashion. Means are provided for independently locking each of the telescoping members 30 in any desired position in the telescopic movement of the telescoping member 30 relative to a respective tubular member 20, so that the lower end of each of the telescoping members 30 can be set at various selected distances from the lower end of a respective tubular member 20. The lower ends of the four telescoping members 30 can then be independently adjusted so that the seat of the chair can be positioned substantially level even when the chair is used on unlevel ground.

As shown in the embodiment of the invention shown in the drawings, the means for independently locking each of the telescopic members 30 to a respective tubular member 20 comprises a relatively narrow, longitudinal slot 40 (see FIG. 3) cut inwardly in each of the tubular members 20 from the lower end of each tubular member 20. As shown in FIGS. 1 and 3, a constricting band 42 is position around the lower end of each of the tubular members 20 and the slot 40 cut in the lower end of each of the tubular members 20. Means are provided for independently tightening each of the constricting bands 42 so that each constricting band 42 squeezes the portion of the lower end of a respective tubular member 20 that has the slot 40 therein and forces the portion of the lower end of each respective tubular member 20 into tight engagement with a respective telescopic member 30 so that the respective telescopic member 30 is locked against movement with respect to the respective tubular member. A commercially available unit comprising the constricting band 42 and a hand operated lever-type handle 44 for tightening the constricting band 42 is preferably utilized in the improvement of the present invention as shown in the FIGS. 1 and 3 of the drawings.

Although preferred embodiments of the improved, folding, lawn chair of the present invention has been illustrated and described, it is to be understood that the present disclosure is made by way of example and that various other embodiments are possible without departing from the subject matter coming within the scope of the following claims, which subject matter is regarded as the invention.

I claim:

1. An improvement in a folding outdoor chair of the type having four legs that extend downwardly from a seat portion of the chair when the chair is unfolded to its working condition in which the chair is capable of having a person sit in said chair, said improvement comprising four elongate tubular members;

means for attaching each of said tubular members to a respective leg of said chair so that a lower end of each tubular member is positioned near a lower end of a respective leg of said chair;

four elongate, telescoping members, each telescoping member being received within a respective tubular member so that a distal end of the telescoping member extends from a lower end of the respective tubular member and the telescoping member can slide into and out of said tubular member in telescopic fashion; and means for independently locking each of said telescoping members in any desired position in the telescopic movement of said telescoping member relative to a respective tubular member, so that the lower end of each of said telescoping members can be set at various selected distances from the lower end of a respective tubular member, wherein said means for independently locking each of said telescopic members to a respective tubular member comprises a relatively narrow, longitudinal slot cut inwardly in each of said tubular members from the lower end of each said tubular member;

a constricting band position around the lower end of each of said tubular members and the slot cut in the lower end of each said tubular members; and means for independently tightening each of the constricting bands so that each said constricting band squeezes the portion of the lower end of a respective tubular member that has said slot therein and forces said portion of the lower end of each respective tubular member into tight engagement with a respective telescopic member so that said respective telescopic member is locked against movement with respect to said respective tubular member, whereby the lower ends of said four telescoping members can be independently adjusted so that the seat of the chair can be positioned substantially level even when the chair is used on unlevel ground.

2. The improvement in a folding outdoor chair in accordance with claim 1 wherein the means for attaching each of the tubular members to a respective leg of said chair comprises at least two, spaced apart clamps for each tubular member, said clamps binding said tubular member to its respective leg.

3. The improvement in a folding outdoor chair in accordance with claim 2 wherein said clamps are screw clamps.

* * * * *